US007129429B2

(12) United States Patent
Trickett et al.

(10) Patent No.: US 7,129,429 B2
(45) Date of Patent: Oct. 31, 2006

(54) LIMIT SWITCH

(75) Inventors: Paul Trickett, Motherwell (GB); James Boyd, Symington (GB)

(73) Assignee: Honeywell Control Systems Limited, Lanarkshire (GB)

( * ) Notice: Subject to any disclaimer, the term of this patent is extended or adjusted under 35 U.S.C. 154(b) by 0 days.

(21) Appl. No.: 10/362,785

(22) PCT Filed: Apr. 11, 2001

(86) PCT No.: PCT/GB01/01636

§ 371 (c)(1),
(2), (4) Date: Aug. 18, 2003

(87) PCT Pub. No.: WO02/19358

PCT Pub. Date: Mar. 7, 2002

(65) Prior Publication Data

US 2004/0045800 A1 Mar. 11, 2004

(30) Foreign Application Priority Data

Aug. 26, 2000 (GB) ..... 0020983.3

(51) Int. Cl.
*H01H 15/14* (2006.01)
*H01H 17/12* (2006.01)

(52) U.S. Cl. ..... 200/47; 200/61.41; 200/284; 200/16 B; 439/409; 439/811

(58) Field of Classification Search ..... 200/47, 200/61.41–61.44, 61.62, 61.71–61.74, 16 B, 200/284; 439/409–410, 811
See application file for complete search history.

(56) References Cited

U.S. PATENT DOCUMENTS 2,747,034 A * 5/1956 Machon et al. ..... 200/16 A
2,776,348 A * 1/1957 Korry ..... 200/450
4,754,104 A * 6/1988 Maltais et al. ..... 200/11 R
5,552,570 A * 9/1996 Shinohara et al. ..... 200/47
5,947,268 A * 9/1999 Lange et al. ..... 200/345
5,959,271 A * 9/1999 Matsuhashi ..... 200/61.41
6,005,210 A 12/1999 Chien (Continued)

FOREIGN PATENT DOCUMENTS

DE 2117589 10/1972

(Continued)

*Primary Examiner*—K. Lee
(74) *Attorney, Agent, or Firm*—Tarolli, Sundheim, Covell & Tummino LLP

(57) ABSTRACT

An electrical limit switch (10) is provided and comprises a number of contact elements (30) each having a slot (32) with inner cutting edges (34) for penetrating the insulation of and containing a conducting element (48). The contact elements (30) are provided on a body which engages a base (56) wherein the base (56) receives a plurality of conducting elements (48). Upon engagement of the body and base (56), the conducting elements (48) are foced into respective slots (32) in the contact elements (30), thus providing a rapid electrical connection. The switching means of the limit switch (1) is provided by an actuating arrangement (14) including a plunger portion (16) and a roller (18), wherein the plunger(16) includes electrical contacts (36*a*, 36*b*) which are moveable with the plunger. Each contact (36*a*, 36*b*) provides an electrical connection between two of the contact elements (30) when the plunger (16) is in the appropriate position. The limit switch (10) includes a cover (12) with respective upper and lower cover portions (12*a*, 12*b*) which are held together by click-lock tabs (20) and grooves (22). Mounted on the upper cover portion (12*a*) is the actuating arrangement (14) and the lower portion (12*b*) terminates in an integral calbe gland (26).

34 Claims, 3 Drawing Sheets

U.S. PATENT DOCUMENTS 6,236,006 B1 5/2001 Wecke
6,312,288 B1 * 11/2001 Genz et al. ..... 439/628

FOREIGN PATENT DOCUMENTS

DE 29905589 U1 7/1999
DE 29908701 U1 9/1999
EP 0859390 A2 8/1998
WO WO 9927551 6/1999

* cited by examiner

LIMIT SWITCH

The present invention relates to an electrical limit switch.

Electrical limit switches are widely used in many applications, and are generally used to make or break an electrical circuit during certain positions of a repetitive movement. Currently-used limit switches generally comprise a combination of modular elements. A basic switch provides most of the electrical functionality; a "head" provides a means for operating the basic switch; and an enclosure both supports the head and the switch, and provides environmental protection for the basic switch.

By far the most common method of connecting the basic switch to the application wiring is by means of screw terminals. These usually have some form of captive washer arrangement which clamps the stripped end of the conductor when the user tightens the screw. When wiring such a switch not only must a portion of the outer jacket be stripped from the cable, but also a portion of the insulation from the ends of the individual cores. The stripped ends of multi-stranded cores are also usually twisted, or have a ferrule crimped on, to prevent a stray strand from causing a short circuit. Smaller sizes of limit switches, such as those conforming to EN50047 (that is, the European standard relating to such products), have very little space within the housing. This tends to make wiring awkward and often the basic switch is removed and wired outside the enclosure. Finger guards and screw driver guides are common features added to switches to ease wiring and prevent accidental electrocution.

To allow access for wiring and removal of the basic switch, enclosures typically have a removable cover. This cover usually forms most of the front side of the enclosure and is held in place by up to four screws or a combination of hinges, clips and screws. These fastenings have to be undone, to allow wiring, and then redone correctly to ensure the enclosure provides the environmental protection intended. Cover seals tend to be of the gasket type with screws having to be tightened to a specific torque range to provide sufficient seal compression. Covers held by multiple screws can offer greater potential for seal compression and often have higher environmental ratings but are correspondingly more time-consuming to remove and replace.

The other area of the enclosure which must be sealed to maintain its environmental rating is the cable exit. In most cases this is done by means of a cable gland This gland is not usually supplied with the limit switch. The gland is screwed into a threaded hole in the enclosure and sealed against the enclosure by either a seal ring or compressible feature on the gland. The gland also seals against the cable by the action of a nut compressing a flexible seal. The cable must be fed through the gland assembly prior to being wired to the basic. The sizes of, and thread forms commonly used on, cable glands vary considerably around the world. It is often necessary therefore to provide several different enclosure options each with a differently threaded cable exit hole.

The switch must be in a location and orientation which will allow access to the cover. This is to facilitate either initial connection, or maintenance at a later date. As there are likely to be a limited number of such locations and orientations it is often necessary to provide a greater number of actuator head configurations or make the head itself such that it can reoriented.

Wiring or configuring a switch in a difficult location is often made more complex by the number of potentially detachable parts. These include: cover, head, basic switch, cover gasket, head screws, basic switch screws, terminal screws, cable gland and the gland seal. The loss of any one of these parts would make completion of the task difficult or impossible.

It is among the objects of embodiments of the present invention to obviate or alleviate these and other disadvantages of known limit switches. It is further among the objects of embodiments of the present invention to provide an improved limit switch with fewer detachable parts, and which is simpler and more rapid to wire and install.

According to a first aspect of the present invention, there is provided an electrical switch assembly, the assembly comprising: a base for receiving a plurality of insulated electrically conducting elements; a body for engaging with the base, said body including electrical contact elements for engaging with the conducting elements, each contact element having a cutting edge for penetrating the insulation of and contacting a conducting element; and switch means located in the body for selectively electrically connecting pairs of contact elements.

In use, therefore, a switch assembly according to the present invention may be wired by simply inserting insulated wires in the base, locating the wires at the cutting edges of the contact elements, and applying pressure to the base and the contact elements. The cutting edges of the contact elements penetrate the insulation of the wires and form an electrical connection, while the selective electrical connection will function as a basic switch. The wiring may thus be achieved more rapidly, and more straightforwardly, than known limit switch arrangements.

Preferably each cutting edge is provided as a slot formed in the contact element, for receiving a portion of the conductor. Either or both edges of the slot may be provided with a cutting edge. In use, the slot may serve to hold the conductor, and prevent or reduce unwanted movement of the conductor.

Preferably at least one of the base and the body is provided with stop means to restrict the relative movement of the base and the body. Without such a stop means, there is a possibility that a user may push the base and the body too far together, and thereby cause the cutting edge of the contact element to cut through the conducting elements so reducing the functionality of the switch.

Preferably the base comprises a plurality of apertures for receiving the conducting elements. Preferably each conducting element is received in a respective aperture. Preferably also the apertures are adapted to receive the contact elements; this eases the alignment and guiding of the conductors to the contact elements. Preferably the apertures include an angled portion with respect to the contact elements; this presents a greater surface of the conductors to the contact elements, so ensuring a more effective electrical connection. Conveniently, the apertures may incorporate stop means to restrict the movement of the contact elements into the apertures.

Preferably the apparatus comprises coupling means for connecting the body and the base together. While the switch assembly may be wired by a user manually inserting a conductor into each contact element, the wiring may be simplified if all conductors and contacts are urged together. Conveniently the coupling means comprises a nut or the like, tightening of which urges the base against the body. The assembly preferably comprises a screw thread on which the nut or the like may be rotated. The screw thread preferably comprises a portion of a cable gland mounted on the assembly. Conveniently the nut includes an opening through which a conductor may pass; and may further be provided in conjunction with a seal, for preventing ingress of unwanted substances to the assembly.

Preferably the selective electrical connecting means comprises a moveable electrical contact. Preferably the electrical contact in a first position forms an electrical connection between two contact elements, while in a second position the two contact elements are not electrically connected. Where the assembly comprises more than two contact elements, the electrical contact may in a first position connect two contact elements, and in a second position connect a different two contact elements. In certain embodiments of the invention, the electrical contact may be moveable between several positions, in each position connecting a different pair of contact elements, or none. The electrical connecting means is preferably biassed towards one position; for example, the connecting means may be spring mounted, the spring urging it into one position. Preferably the connecting means comprises a plunger, axial movement of which makes or breaks connections; however, any suitable form of connecting means may be used, as will be readily apparent to the skilled person.

Preferably four contact elements are provided; preferably also the elements are arranged in two alternately connected pairs. Alternatively, the elements may be arranged in two pairs which are both either electrically connected or not electrically connected at any one time. This type of switch provides redundancy in the connections, and may therefore be used in safety applications, among others, where a level of redundancy is desired.

Preferably the assembly further comprises a cover. Conveniently the cover is substantially sealed. Preferably the interior of the cover is not normally user-accessible. Due to the nature of the present invention, wiring and assembly of the apparatus may be achieved without requiring access to the internal parts of the assembly. Thus, environmental integrity and sealing of the cover is not dependent on the user correctly fitting the cover; and the simpler design enables simpler, more reliable seals to be used. Preferably the cover includes an integral cable gland. Conveniently the cover comprises two portions; preferably these portions snap-fit together. An upper portion may comprise an actuating arrangement for the selective connection means, while a lower portion covers the body and base of the assembly. The separate actuating arrangement enables various modifications and alternatives to be made to the assembly without the need for extensive redesign.

Preferably the assembly is a limit switch.

According to a second aspect of the present invention, there is provided a method of wiring an electrical limit switch, the method comprising the steps. of:

inserting a plurality of insulated electrical conductors into a receiving base; and engaging the insulated conductors with a plurality of contact elements each having a cutting edge and pairs of the contact elements being selectively electrically connected, such that the cutting edge penetrates the insulation of and contacts the conducting elements to form an electrical connection.

These and other aspects of the present invention will now be described by way of example only and with reference to the accompanying drawings, in which.

Figure 1:
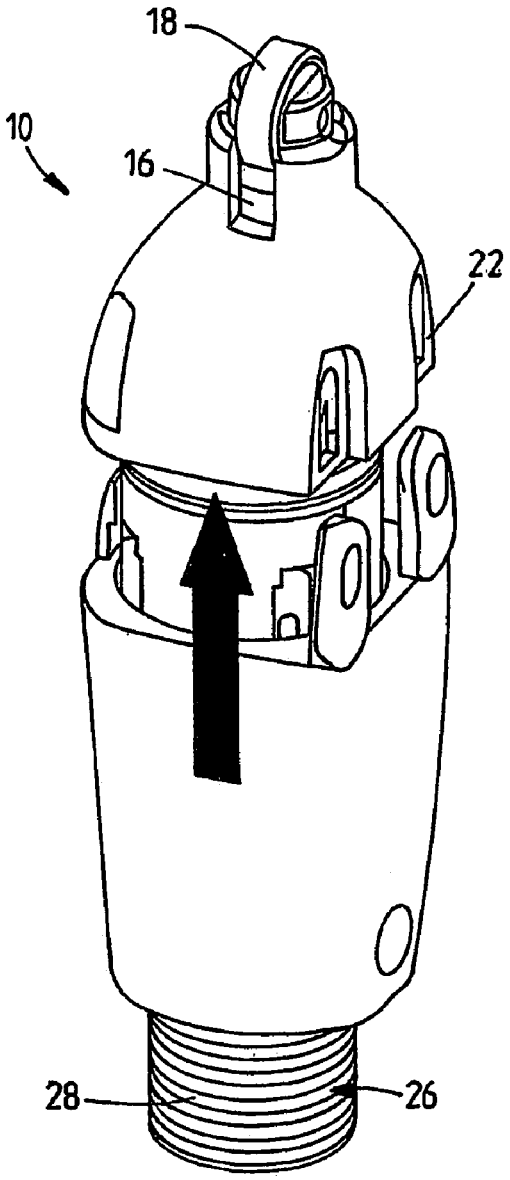
FIGS. 1 and 2 show left and right perspective views of an embodiment of a limit switch in accordance with the present invention.
Figure 2:
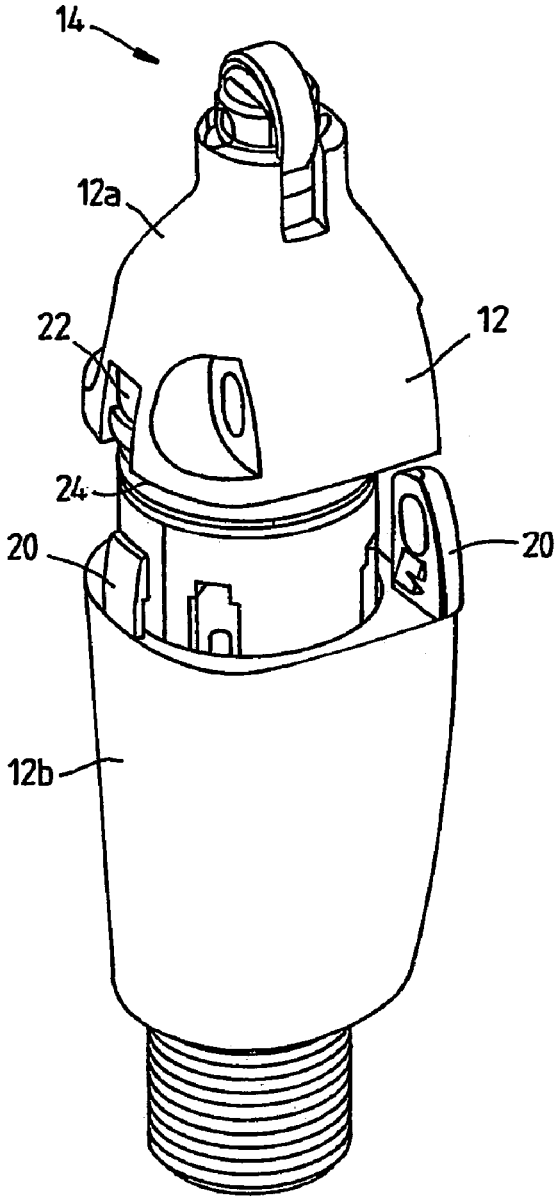
Figure 5:
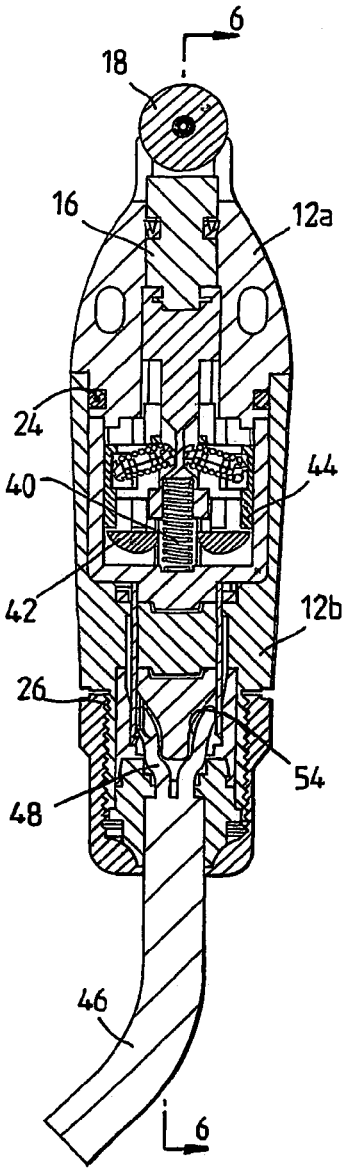
Figure 6:
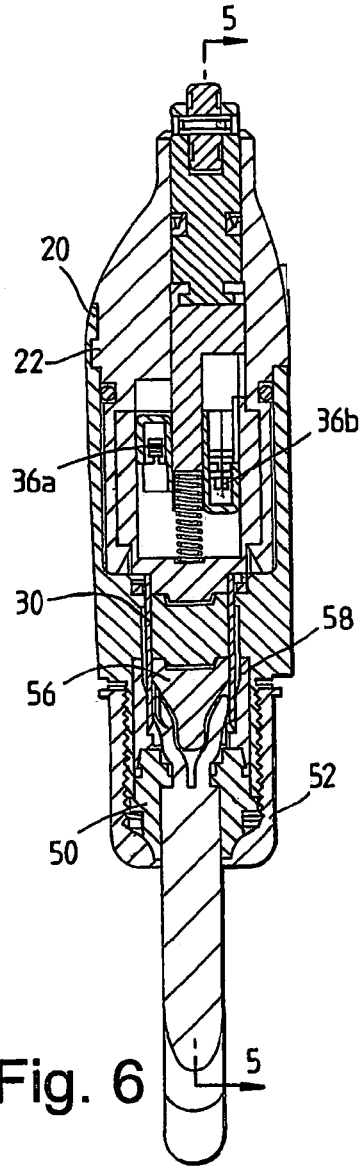
Figure 7:
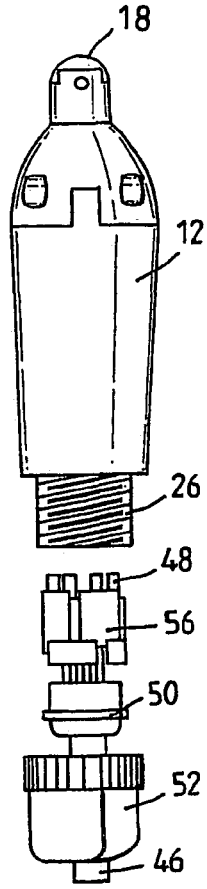

FIGS. 5 and 6 show longitudinal sectional views of the switch of FIGS. 1 and 2, as assembled and wired; and FIG. 7 shows an exploded external view of the switch of FIGS. 5 and 6.

Referring first of all to FIGS. 1 and 2, these show the external appearance of a limit switch in accordance with the present invention. The limit switch 10 includes a cover 12 with respective upper and lower cover portions 12*a*, 12*b* shown partly separate for clarity. On the upper cover portion 12*a* is mounted an actuating arrangement 14 for the switch, including a plunger portion 16 and a roller 18. Both portions 12*a*, 12*b* of the case 12 are provided with click-lock tabs 20 and grooves 22, to hold the case 12 together, and an O-ring seal 24 located between the two portions, to provide a seal. The lower portion of the case 12*b* terminates in an integral cable gland 26, on which is provided a screw thread 28.

Figure 3:
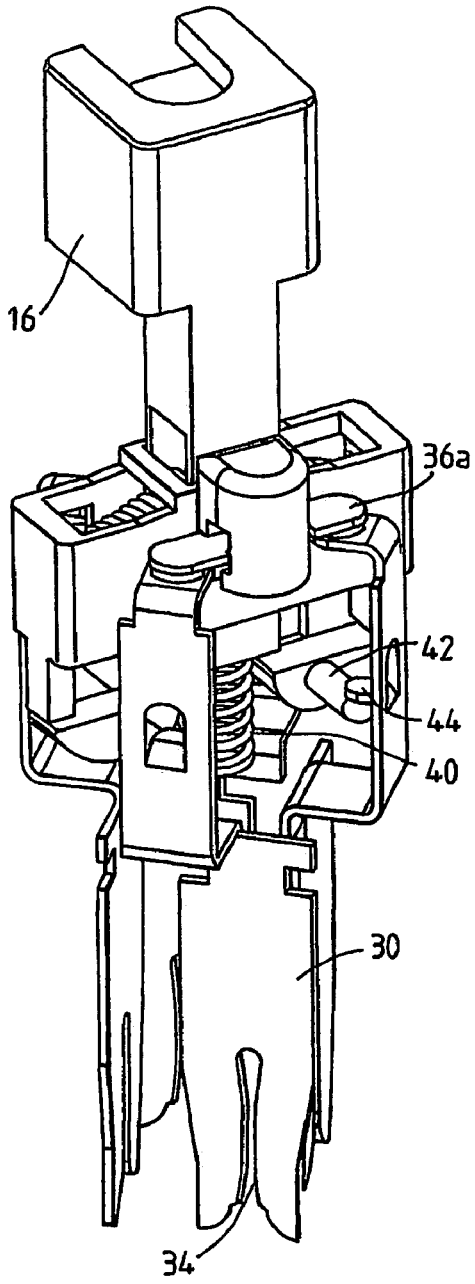
FIGS. 3 and 4 show perspective views of the switch of FIGS. 1 and 2, with the case removed.
Figure 4:
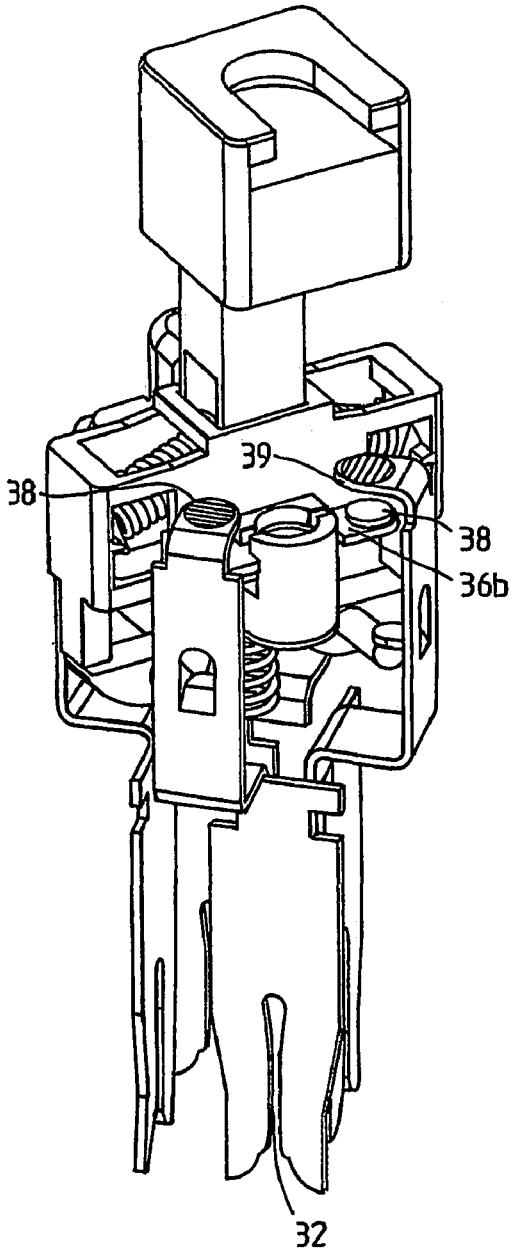

Views of the switch 10 of FIGS. 1 and 2 with the cover 12 removed are shown in FIGS. 3 and 4. The switch includes four contact elements 30, each of which includes a slot 32 on the lower portion thereof, the slot having inner cutting edges 34. The lower portions of the contact elements 30 extend into the cable gland 26.

The plunger 16 of the actuating arrangement 14 includes two electrical contacts 36*a*, 36*b* which are vertically moveable with the plunger 16. Each contact 36 provides an electrical connection between two of the contact elements 30 when the plunger 16 is in the appropriate upper or lower position, as described below. Each contact 36 and contact element 30 is also provided with opposed contact plates 38 for forming electrical connections.

The plunger 16 is mounted on a compression spring 40 which is biased to urge the plunger 16 upwards, such that the contact 36*b* abuts a lower face of two of the contact elements 30, so forming an electrical connection therebetween. The plunger 16 also carries a pair of cam members 42, which abut stops 44 provided on the contact elements 40, to limit the movement of the plunger 16.

When the plunger 16 is depressed, the contact 36*b* moves downward, so breaking the connection between the two contact elements 30, while the other contact 36*a* is moved to abut the upper face of the other pair of contact elements 30, so forming an electrical connection between these elements.

The assembly is therefore able to act as a switch to alternate an electrical connection between pairs of conductors.

In an alternative arrangement, a switch may be provided as a 'snap action' switch, with the moving contacts being held in a carrier which is connected to the plunger via two over-centre snap springs. When the plunger is depressed, the snap springs go over-centre making the carrier and moving contacts move upward. A positive break type switch may also be provided. FIGS. 5 and 6 show cross-sectional views of the assembly of FIGS. 3 and 4 when connected to an electrical cable 46. The cable 46 includes four insulated conductors 48, each of which is held in apertures 54 formed in a base 56, which also receives the contact elements 30. Around the cable 46 is mounted an elastomeric seal 50, which in turn is surrounded by a nut 52, which engages with the screw thread 28 of the cable gland 26.

An exploded view of the external appearance of the switch is shown in FIG. 7.

In use, the switch is wired as follows. A cable 46 is inserted through the nut 52 and seal 50. The outer layer of insulation is removed from the cable 46, to expose the four insulated conducting wires 48. Each of these wires 48 is then inserted into a aperture 54 of the base 56. The base 56 is then aligned with the contact elements 30, which extend into the cable gland 26, and the base 56 then pushed into the cable gland. This causes the contact elements 30 to enter vertical openings 58 provided in the base 56, and the wires 48 to enter the slot 32 formed in the contact elements 30. The nut 52 is then tightened on the cable gland 26, which seals the switch unit, and pushes the wires 48 against the cutting edges 34 of the contact elements, to cut through the layer of insulation on the wires 48, so creating an electrical contact between the wires 48 and the contact element 30. The switch is then assembled and ready for use.

It can be seen from the foregoing that the present invention provides a switch which is simple and rapid to wire and install; requires no user access to the internal components; and has relatively few detachable parts. Thus, the switch has several advantages over known limit switch arrangements.

It will be understood that various modifications may be made to the apparatus herein described. For example, it will be clear to the person of skill in the art that a switch according to the present invention may be made in a variety of arrangements; for example, two normally closed, two normally open, one normally open and one normally closed, break before make, make before break, and such like. Details of such arrangements will be apparent to the skilled person on the basis of the arrangement herein described.

The invention claimed is:

1. An electrical switch assembly, the assembly comprising:

a base for receiving a plurality of insulated electrically conducting elements;

a body for engaging with the base, said body including electrical contact elements for engaging with the conducting elements, each contact element having a cutting edge for penetrating the insulation of and contacting a conducting element; and switch means located in the body for selectively electrically connecting pairs of contact elements through rectilinear motion of the switch means.

2. The electrical switch assembly of claim 1, wherein each cutting edge is provided as a slot formed in the contact element, for receiving a portion of the conductor.

3. The electrical switch assembly of claim 2, wherein at least one edge of the slot is provided with a cutting edge.

4. The electrical switch assembly of claim 1, wherein at least one of the base and the body is provided with stop means to restrict the relative movement of the base and the body.

5. The electrical switch assembly of claim 1, wherein the base comprises a plurality of apertures for receiving the conducting elements.

6. The electrical switch assembly of claim 5, wherein each conducting element is received in a respective aperture.

7. The electrical switch assembly of claim 5, wherein the apertures are adapted to receive the contact elements.

8. The electrical switch assembly of claim 7, wherein the apertures include an angled portion with respect to the contact elements.

9. The electrical switch assembly of claim 7, wherein the apertures incorporate stop means to restrict the movement of the contact elements into the apertures.

10. The electrical switch assembly of claim 1, wherein the assembly further comprises coupling means for connecting the body and the base together.

11. The electrical switch assembly of claim 10, wherein the coupling means comprises a nut, tightening of which urges the base against the body.

12. The electrical switch assembly of claim 1, wherein the assembly further comprises a screw thread on which the nut is rotated.

13. The electrical switch assembly of claim 12, wherein the screw thread comprises a portion of a cable gland mounted on the assembly.

14. The electrical switch assembly of claim 12, wherein the nut includes an opening through which a conductor may pass.

15. The electrical switch assembly of claim 14, wherein the opening in the nut is provided with a seal, for preventing ingress of unwanted substances to the assembly.

16. The electrical switch assembly of claim 1, wherein the selective electrical connecting means comprises a moveable electrical contact.

17. The electrical switch assembly of claim 16, wherein the electrical contact in a first position forms an electrical connection between two contact elements, while in a second position the two contact elements are not electrically connected.

18. The electrical switch assembly of claim 16, wherein the electrical connection in a first position forms an electrical connection between two contact elements, while in a second position form an electrical connection between a different two contact elements.

19. The electrical switch assembly of claim 16, wherein the electrical contact is moveable between several positions, in each position connecting a different pair of contact elements, or none.

20. The electrical switch assembly of claim 1, wherein the assembly comprises more than two contact elements.

21. The electrical switch assembly of claim 1, wherein the selective electrical connecting means is biased towards one position.

22. The electrical switch assembly of claim 1, wherein the selective electrical connecting means is spring mounted, the spring urging the selective connecting means into one position.

23. The electrical switch assembly of claim 1, wherein the selective electrical connecting means comprises a plunger, axial movement of which makes or breaks connections.

24. The electrical switch assembly of claim 1, wherein the assembly comprises four contact elements.

25. The electrical switch assembly of claim 24, wherein the contact elements are arranged in two alternately-connecting pairs.

26. The electrical switch assembly of claim 24, wherein the contact elements are arranged in two pairs which are both either electrically connected or not electrically connected at any one time.

27. The electrical switch assembly of claim 1, wherein the assembly further comprises a cover.

28. The electrical switch assembly of claim 27, wherein the cover is substantially sealed.

29. The electrical switch assembly of claim 27, wherein the cover comprises two portions.

30. The electrical switch assembly of claim 29, wherein the portions of the cover snap-fit together.

31. The electrical switch assembly of claim 30, wherein the cover comprises an upper portion and a lower portion.

32. The electrical switch assembly of claim 31, wherein the upper portion comprises an actuating arrangement for the selective electrical connection means, while the lower portion covers the body and base of the assembly.

33. The electrical switch assembly of claim 1, wherein the assembly is a limit switch.

34. The electrical switch assembly of claim 1, wherein the body defines a vertical axis and the pairs of contact elements are selectively electrically connected through the rectilinear motion of the switch means along the vertical axis.

* * * * *